US010000943B1

(12) United States Patent
Pawlicki

(10) Patent No.: US 10,000,943 B1
(45) Date of Patent: Jun. 19, 2018

(54) BEAUTIFICATION AND PRIVACY FENCE PANEL SYSTEM AND USES THEREOF

(71) Applicant: Sean Patrick Pawlicki, Ramona, CA (US)

(72) Inventor: Sean Patrick Pawlicki, Ramona, CA (US)

( * ) Notice: Subject to any disclaimer, the term of this patent is extended or adjusted under 35 U.S.C. 154(b) by 0 days. days.

(21) Appl. No.: 15/284,474

(22) Filed: Oct. 3, 2016

Related U.S. Application Data

(60) Provisional application No. 62/236,893, filed on Mar. 10, 2015.

(51) Int. Cl.
*E04H 17/04* (2006.01)
*E04H 17/06* (2006.01)
*E04H 17/16* (2006.01)

(52) U.S. Cl.
CPC ..... *E04H 17/066* (2013.01); *E04H 17/04* (2013.01); *E04H 17/168* (2013.01)

(58) Field of Classification Search
CPC ..... E04H 17/16; E04H 17/165; E04H 17/066
See application file for complete search history.

(56) References Cited

U.S. PATENT DOCUMENTS 2,019,379 A * 10/1935 Anderson ..... E06B 9/15 160/235
4,091,588 A * 5/1978 Heirich ..... E04B 9/363 52/478
4,223,503 A * 9/1980 Hague ..... E04D 3/362 52/394
4,283,897 A * 8/1981 Thompson ..... E04B 1/80 52/478
4,699,251 A * 10/1987 Orndorff ..... B66B 11/0226 187/401
4,918,898 A * 4/1990 McLeod, Jr. ..... E04F 13/12 52/478
5,725,201 A * 3/1998 Parth ..... E04C 2/20 160/235
5,842,545 A * 12/1998 Blaiotta ..... B66B 11/0253 187/401
6,082,501 A * 7/2000 Lehmann ..... B66B 11/0253 187/401
6,739,374 B1 * 5/2004 Mouzakis ..... E06B 9/36 160/178.1 V
8,966,830 B2 * 3/2015 Trenkler ..... E05D 1/04 405/279

* cited by examiner

*Primary Examiner* — Jonathan P Masinick

(57) ABSTRACT

An interlocking plastic fence panel system is described herein that improves the appearance, provides privacy and acts as a wind screen for preexisting chain link fencing. The complementary edges of the panels allow two adjacent panels to be positively joined such that displacement of the panels away from one another is prevented. The interlocking panels are attached with fasteners and can positioned vertically, horizontally, diagonally or any varying angel in between. A decorative texture and or printing can be applied to the surface to enhance the appearance. For example, wood grain texture and printed imagery or advertisements.

2 Claims, 5 Drawing Sheets

FIG. 15
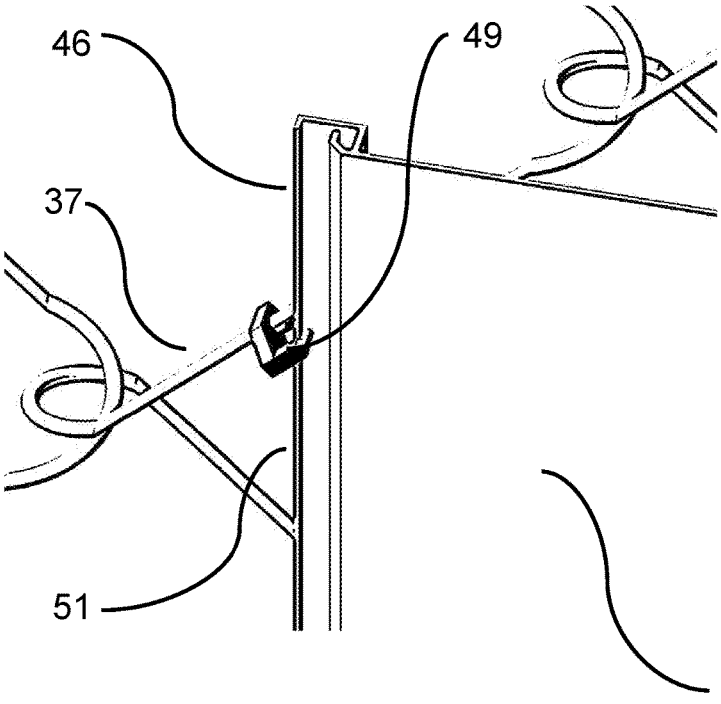
FIG. 16
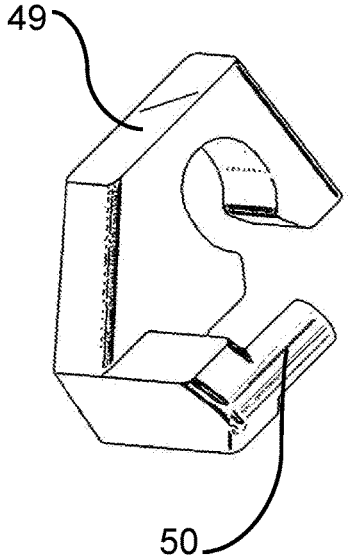
FIG. 17
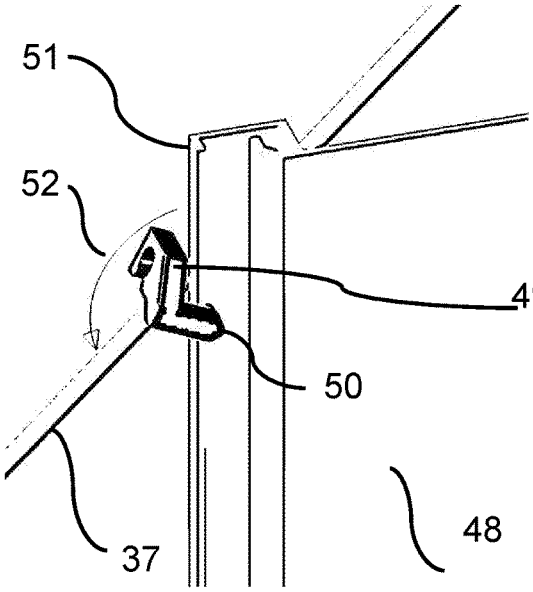
FIG. 18
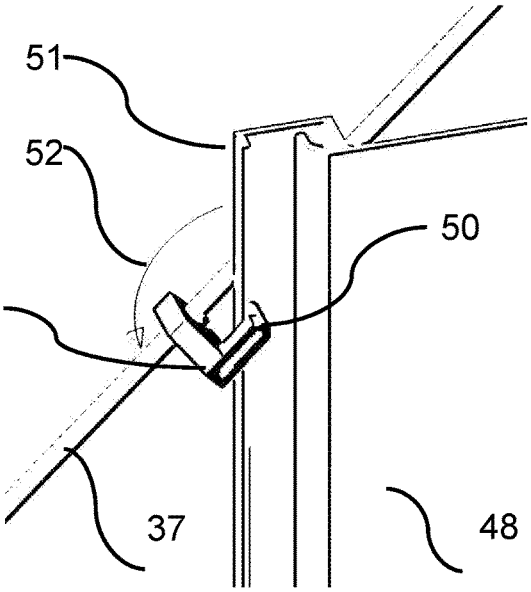

BEAUTIFICATION AND PRIVACY FENCE PANEL SYSTEM AND USES THEREOF

RELATED APPLICATION DATA

This application claims the benefit of U.S. provisional patent application 62/236,893 filed on Oct. 3, 2015. The present invention is directed to a privacy system for chain link fences.

BACKGROUND INFORMATION

Chain link fences have been widely used for many years to satisfy fencing requirements. While they provide acceptable strength and durability over many years, they do not provide privacy or serve as a windbreak do to their apertured construction. To deal with these shortcomings, a number of solutions have been developed. Heretofore, slats have generally been woven through the fabric of the chain link fence. Such slats do not provide complete privacy or wind protection inasmuch as they block only a portion of the view and wind through the fence.

While a wide variety of privacy slats have been suggested, the various configurations used today typically provide slats extending in the same direction disposed in a spaced, or at best an abutting, arrangement. Due to imperfections in manufacture and the inherent design of chain link fences which have a "knuckle" formed where individual strands of the chain link fence meet, previously suggested designs leave gaps between the slats. Since the ultimate design of such slats is to maximize privacy, it is highly desirable to provide a beautification and privacy fence panel system which has no gaps between adjoining slats or panels.

In addition, all prior slats are installed, within the fabric of the chain link mesh itself, wherein the wire of the fence encapsulates the slat. As a result, the wire always remains visible. In this case it is again highly desirable to provide a beautification and privacy fence panel system that completely obscures and eliminates the sight of the existing chain link fence wire.

Another aspect that is lacking in the use of slats is the ability to print and/or add texture to the surface due to the large gaps created by the knuckle of the chain link, preventing a cohesive image or texture. Also, being behind the wire fabric, any image or texture would be obscured. Therefore, it is highly desirable to make a panel that attaches to the outside of the fence.

It is also highly desirable to provide a beautification and privacy fence panel system which is relatively low in cost and easy to install while enhancing the privacy characteristics of the fence.

SUMMARY OF THE INVENTION

Embodiments of the present invention are directed to beautification and privacy panels wherein a plurality of the elongated panels are positioned vertically, horizontally, diagonally or any varying angle in between, and are attached by means of a) a rigid fastener that engages the panel and then hooks or snaps onto the wire of the chain link mesh, or b) an elastic fastener that engages the panel and then wraps around the wire or knuckle of the chain link mesh, then terminating with a final engagement to the panel.

A panel constructed in accordance with the invention has first and second side edges opposite each other. These opposing edges of each panel have either male or female characteristics wherein the first side edge can be interlocked with the second side edge of an additional panel of the invention. The mating of these edges is achieved by engaging a panel to a previously installed panel, at a 90 degree angle in relation to the plane of the fence. The panel is then rotated flat to align with the plane of the fence, thus engaging a hooked edge, which prevents disconnection in a longitudinal direction. Some play exist in this connection to allow for expansion and contraction due to thermal loads placed on the panel system by external forces, such as elements of weather. These expansion joints prevent buckling and displacement of the panels once installed.

A particular objective that is met by the present invention is, by connecting a series of panels together, a continuous surface is created, which is not broken by gaps or protruding wire mesh from the chain link itself, on which textures and/or imagery may be applied for purposes of beatification or advertisement.

Assembly and instillation of the panels may be performed by as few as one single person. Said person can accomplish this from the same side of the fence on which the panels are being installed, eliminating the need for access to the opposite side of the fence. The panels may be installed on one of either side of the chain link mesh or both sides simultaneously.

BRIEF DESCRIPTION OF DRAWING

A clear understanding of the present invention will be had upon reference to the accompanying drawings wherein like reference numerals refer to like parts throughout and wherein:

FIG. 15 is a frontal isometric view of an alternate form for fastening panels hereafter referred to as fastener (C).

FIG. 16 is an isometric view depicting fastener (C).

FIG. 17 is a frontal isometric view of the initial position for attaching fastener (C) to the panel and fence wire.

FIG. 18 is a frontal isometric view of the final position of fastener (C) in the panel and fence wire.

DETAILED DESCRIPTION OF THE INVENTION

Figure 1:
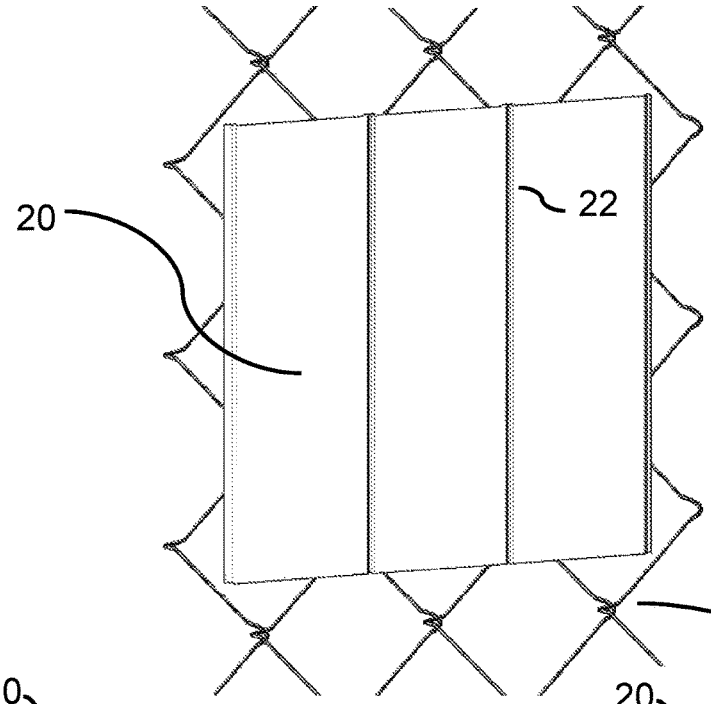
FIG. 1 is an isometric view of the embodiment of the invention illustrating vertical positioning of panels on a chain link fence.
Figure 2:
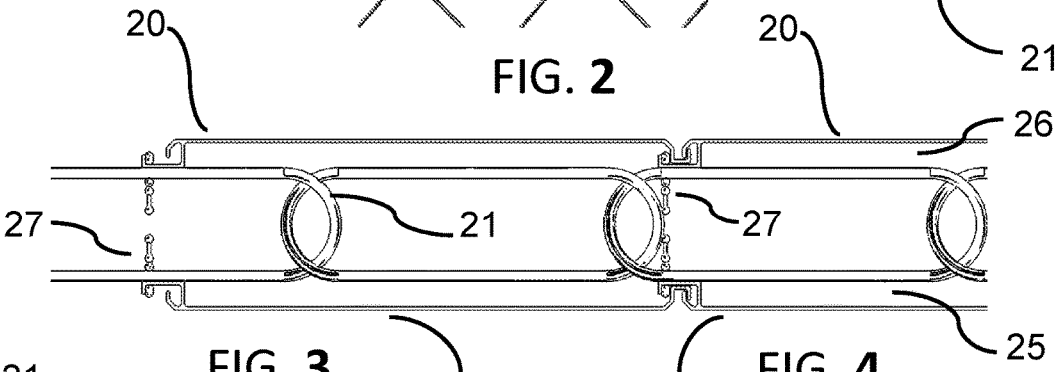
FIG. 2 is a top view of the preferred embodiment of the invention illustrating the panels affixed to both the near and far side of the chain link fence.
Figure 3:
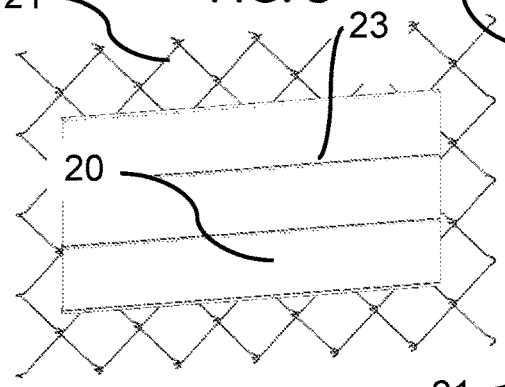
FIG. 3 is an isometric view of the embodiment of the invention illustrating horizontal positioning of panels on a chain link fence.
Figure 4:
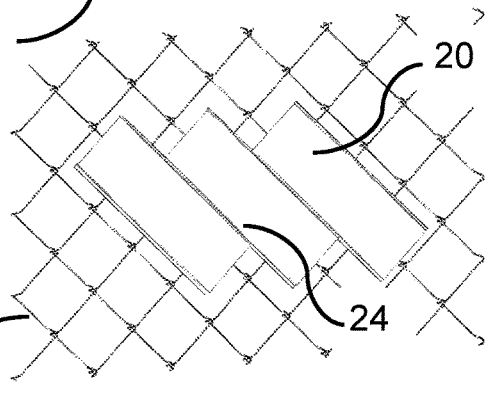
FIG. 4 is an isometric view of the embodiment of the invention illustrating diagonal positioning of panels on a chain link fence.

As illustrated in FIGS. 1, 3 and 4 there is shown a plurality of beautification and privacy fence panel 20 system installed on an otherwise conventional chain link fence 21. Panels 20 are comprised of a (polyvinyl or similar material) extrusion and can vary in length, but typically extend the full height of the chain link fence 21, and can be attached vertically 22, horizontally 23, diagonally 24 or any varying angle in between with fasteners 27. Panels 20 are affixed to the outside portion of the chain link mesh 21 on one or both sides, whereas the installation of panels 20 to the near side 25 does not interfere with the installation of panels 20 to the far side 26 as illustrated in FIG. 2. All installation and fastening procedures can be performed solely from the side in which the panels 20 are being installed eliminating the need for access to the opposing side of the fence.

Figure 5:
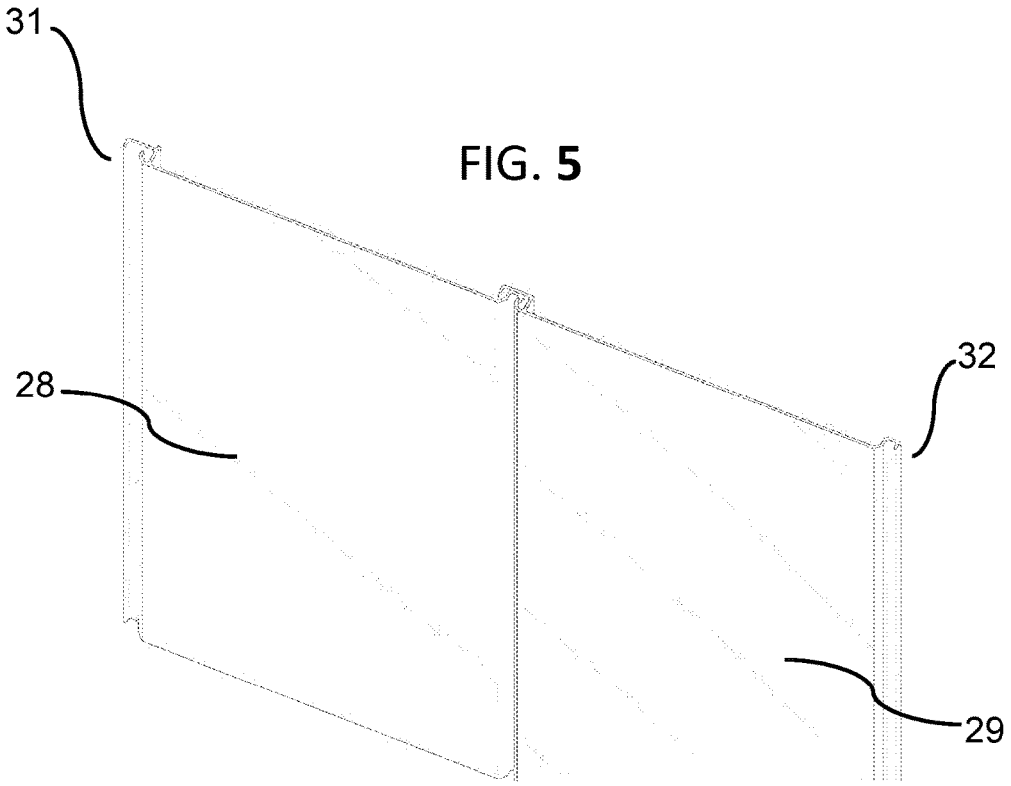
FIG. 5 is an isometric view of interlocking fence panels.
Figure 6:
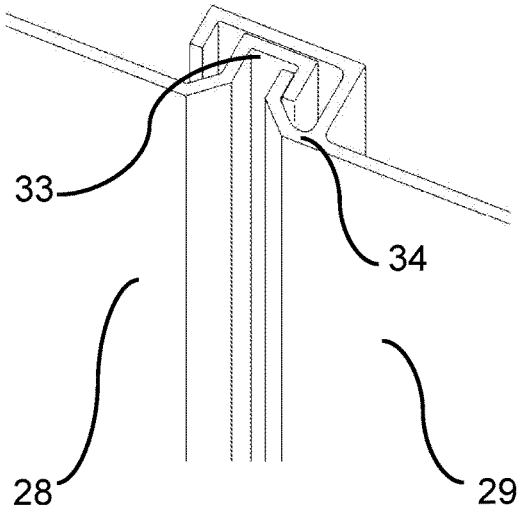
FIG. 6 is a detailed isometric view of connected panel edges.
Figure 7:
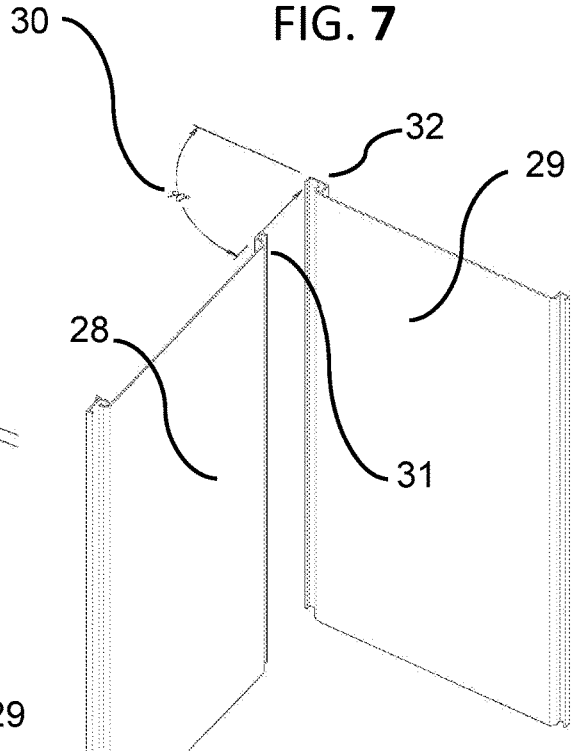
FIG. 7 is an isometric view of the initial position for edge connecting procedure.

As illustrated in FIG. 7 a new panel 28, in a perpendicular attitude 30 to the plane of the chain link fence 21, demonstrates the initial position for interlocking the joints. The male 31 edge is inserted into the female 32 grooved edge of the previously installed panel 29. The new panel 28 is then rotated 90 degrees to rest flat, as illustrated in FIG. 5, so that the surface of the new panel 28 becomes coplanar with the surface of the previously installed panel 29 and fence surface. When rotation is completed the lip 33 of the male 31 hooked edge is engaged behind the lip 34 of the female 32 edge preventing longitudinal disengagement. FIG. 6 is a detailed view of a previously installed panel 29 and new panel 28 joint engagement. Once the new panel 28 is in a coplanar position with the previously installed panel 29, a fasteners are then attached, connecting the new panel 28 to the chain link fence 21 itself. The process of adding new panels 28 and attaching them with fasteners is then repeated until a desired amount of fence coverage is achieved.

Figure 8:
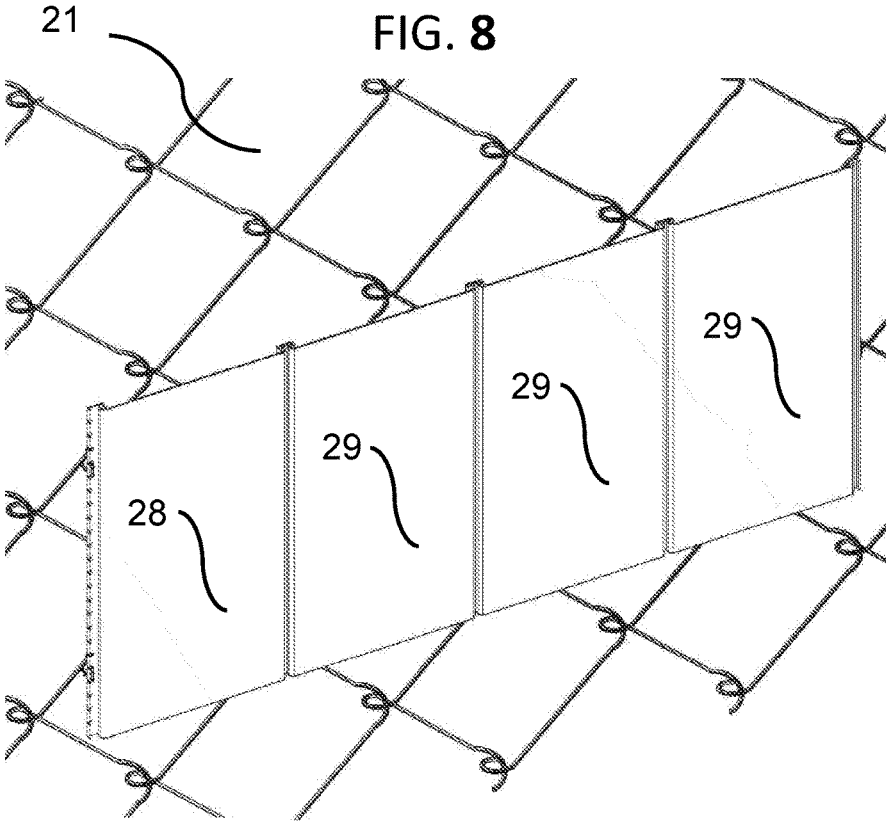
FIG. 8 is an isometric view of the preferred embodiment of the panel and fastener hereafter referred to as fastener (A).
Figure 9:
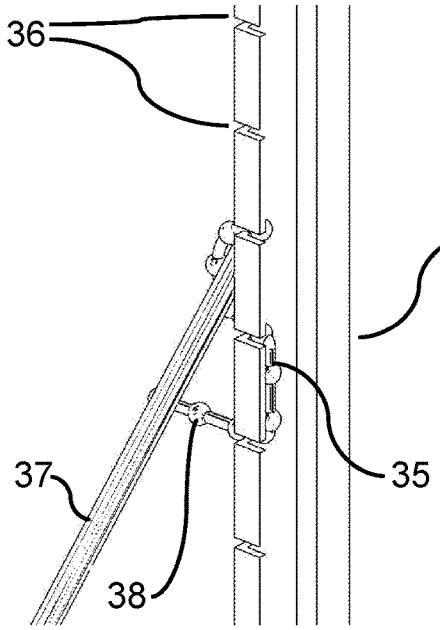
FIG. 9 is a frontal isometric detailed view of the preferred fastening method (A).
Figure 10:
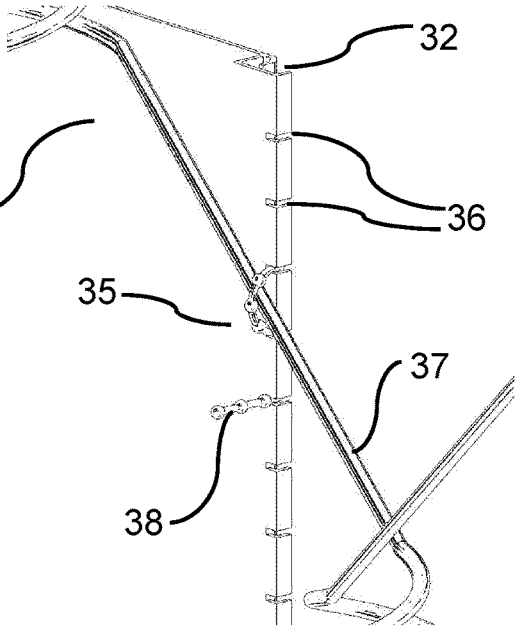
FIG. 10 is a rear isometric detailed view of the preferred fastening method (A).

FIG. 8 illustrates the preferred embodiment previously referred to as fastener (A). FIGS. 9 and 10 illustrates fastener (A) in its final engaged position. Fastener (A) is commonly referred to as a beaded chain 35 and is constructed from neoprene or polychloroprene plastic (or similar material), which possess properties of elasticity and tremendous strength. These properties allow for the beaded chain 35 to be engaged in one of a series of die cut slots 36 occurring along the female 32 edge of the new panel 28. The beaded chain 35 is then wrapped around the wire 37 of the chain link fence 21, stretched, and pulled tight, then engaged again though another die cut slot 36 which locks the beaded chain 35 into place and maintains tension. The remainder 38 of the beaded chain 35 can then be brought down and passed though yet another die cut slot 36 extending toward the back of the new panel 28, or trimmed off, so that the excess does not interfere with the installation of the next panel.

Figure 11:
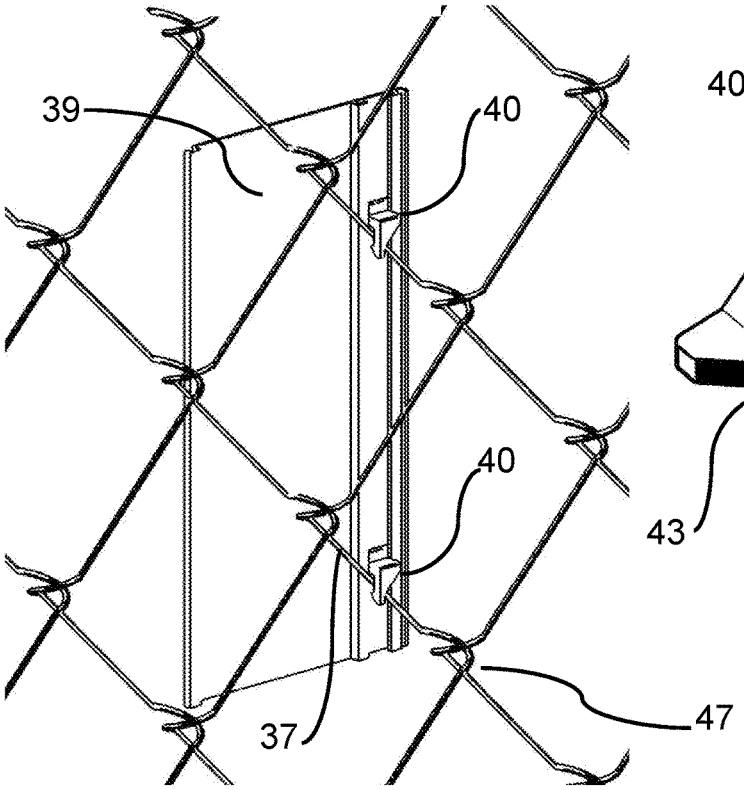
FIG. 11 is a rear isometric view of an alternate form for fastening panels hereafter referred to as fastener (B).
Figure 12:
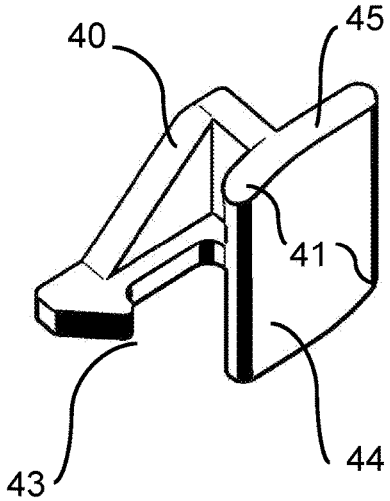
FIG. 12 is an isometric view depicting fastener (B).
Figure 13:
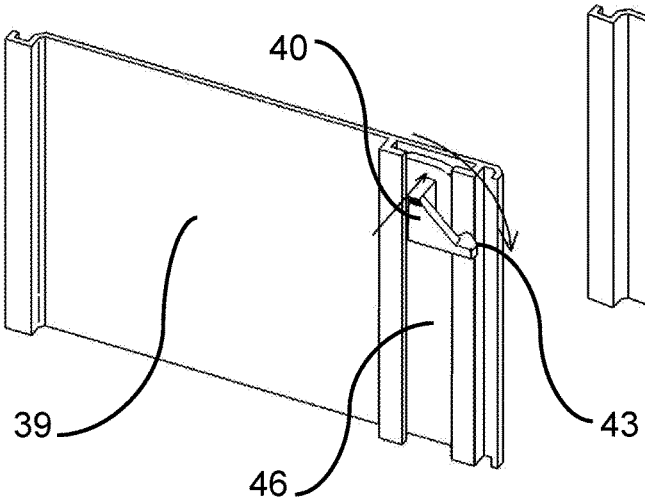
FIG. 13 is a rear isometric view of the initial position for attaching fastener (B) to the panel.
Figure 14:
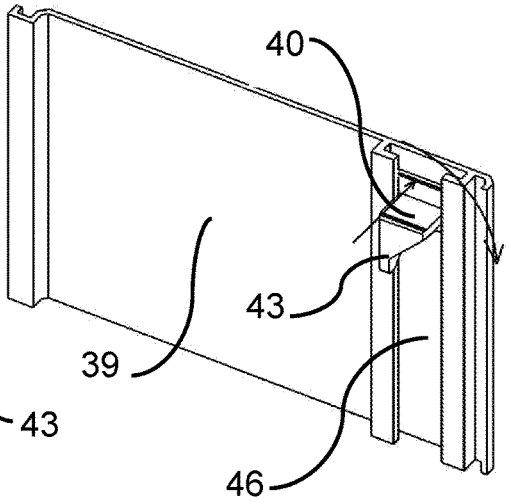
FIG. 14 is a rear isometric view of the final position of fastener (B) in the panel.

FIG. 11 illustrates an alternate version of the panel 39 construction, in addition to an alternate version of a fastener previously referred to as fastener (B) 40. As illustrated in FIG. 12 the base of fastener (B) 40 has two rounded corners 41 that are diagonal to each other. These rounded corners 41 allow for unimpeded rotation, in a single direction, of the fastener. In this version of the panel a "T-shaped" slot 42 is formed in the extruded profile. In this "T-shaped" slot 42, fastener (B) 40 is inserted with the hooked end 43 in a perpendicular orientation, as illustrated in FIG. 13, to the length of the slot. Once the bottom surface 44 of the base 45 is in full contact with the inside surface 46 of the "T-shaped" slot 42, the fastener is then rotated 90 degrees, which locks the fastener into position. At this point, as illustrated in FIG. 14, the hook 43 portion is pointed in a downward orientation. The initial position of the fastener hook 43, being perpendicular to the length of the "T-shaped" slot 42, can be alternately installed in the same manner as described above, except starting 180 degrees in the opposite direction still being perpendicular to the "T-shaped" slot 42. With this alternation approach, the final position of the hook 43 is pointed in an upward orientation. Because the hook 43 portion of the fastener is offset to one side, and not centered, the final position of the hook 43 can be shifted in relation to the location of the panel, providing adjustment when required. For example, if a knuckle 47 is present and would prevent the fastener from snapping onto the wire 37, the fastener may then be rotated 180 degrees to shift the center line of the hook over and out of alignment with the offending knuckle 47.

FIG. 15 illustrates yet another alternate version of the panel 48 construction in addition to an alternate version of a fastener previously referred to as fastener (C) 49. This version of the panel is identical to the panels 28, 29 in FIGS. 8, 9 and 10. Fastener (C) 49, having a rounded peg 50 as illustrated in FIG. 16, hooks over the lip 51 at the end of the female 32 edge of the panel 48. This rounded peg 50 allows for rotational movement 52 of the fastener so it may be snapped onto the chain link fence wire 37. FIG. 17 illustrates the rounded peg 50 end of the fastener engaged over the lip 51 at the end of the panel 48 in its initial upward orientation. The fastener is then rotated down pivoting on the rounded peg 50 end, thus snapping around the chain link fence wire 37. FIG. 18 illustrates the fastener in its final "snapped on" position.

I claim:

1. A Beautification and Privacy Fence Panel System comprising:

a plurality of extruded plastic panels comprised of a polyvinyl extrusion and can vary in length, and can be attached vertically, horizontally, diagonally or any varying angle in-between;

with each of said panels having first and second side locking elements by means of which two or more panels are interconnected in perpendicular attitude to the vertical side surface or plane of a previously existing fence with each of said panels possessing one male edge comprising a U-shaped member situated so that the opening of said U-shape is generally facing away from said surface or plane of said existing fence, and one female edge opposite of said male edge comprising a J-shape member situated so that the hooked shaped portion of said J-shape is generally facing toward said surface or plane of said existing fence whereas said male edge is inserted into said female edge of a previously installed panel; and the panel being installed, is then rotated 90 degrees to rest flat so that the surface of said panel becomes coplanar with the surface of a previously installed panel and said surface or plane of said existing fence; and when rotation is completed, said U-shaped portion of said male edge is engaged behind said hooked shaped portion of said female edge preventing longitudinal disengagement; and when fully engaged a first and second side void is formed directly adjacent to the left and right sides of said U-shaped male edge when viewed from a top down orientation; whereas said first and second side voids provide space for expansion and contraction in a longitudinal direction caused by thermal loads and/or elements of weather placed on said panels by external forces for the purpose of preventing buckling or displacement;

whereas each panel lies on one or both of said surfaces or planes of said existing fence, so that the installation of said panels to the near side does not interfere with the installation of said panels to the far side.

2. The Beautification and Privacy Fence Panel System as described in claim 1, wherein;

said panels are attached by means of said fastener being constructed from neoprene or polychloroprene plastic; and said fastener is engaged to said panel through a series of die cut holes or slots occurring along said female edge of said panel; said fastener encompasses portions of said existing fence which locks said panel into place and maintains position; said fasteners are only attached to said female edge thus allowing for expansion and contraction.

* * * * *